US006439292B1

(12) United States Patent
Schütte et al.

(10) Patent No.: US 6,439,292 B1
(45) Date of Patent: Aug. 27, 2002

(54) ROLLING DOOR WITH A FLEXIBLE DOOR LEAF

(75) Inventors: Wolfgang Schütte, Anröchte; Holger Siewart, Rheda-Wiedenbruck, both of (DE)

(73) Assignee: Schieffer Tor-und Schutzsysteme GmbH, Lippstadt (DE)

( * ) Notice: Subject to any disclaimer, the term of this patent is extended or adjusted under 35 U.S.C. 154(b) by 0 days.

(21) Appl. No.: 09/509,160

(22) PCT Filed: Sep. 2, 1998

(86) PCT No.: PCT/EP98/05566

§ 371 (c)(1),
(2), (4) Date: Jun. 8, 2000

(87) PCT Pub. No.: WO99/15754

PCT Pub. Date: Apr. 1, 1999

(30) Foreign Application Priority Data

Sep. 22, 1997 (DE) ..... 297 16 966 U

(51) Int. Cl.[7] ..... A47G 5/02
(52) U.S. Cl. ..... 160/265; 160/270
(58) Field of Search ..... 160/265, 310, 160/1, 7, 273.1, 271, 322, 270

(56) References Cited

U.S. PATENT DOCUMENTS 4,953,608 A * 9/1990 Larsson ..... 160/310 X
4,974,658 A * 12/1990 Komatsu et al. ..... 160/310
5,025,847 A 6/1991 Mueller
5,353,859 A * 10/1994 Oltahfer et al. ..... 160/310
5,601,133 A * 2/1997 Krupka et al. ..... 160/265
5,620,039 A 4/1997 Delgado et al.
5,638,883 A 6/1997 Schulte
6,082,433 A * 7/2000 Vafaie et al. ..... 160/310

FOREIGN PATENT DOCUMENTS

| | | |
|---|---|---|
| DE | 3709592 | 10/1988 |
| DE | 4007280 | 8/1991 |
| DE | 4313062 | 10/1994 |
| DE | 4414524 | 10/1995 |
| DE | 4447598 | 3/1997 |
| EP | 0675261 | 10/1995 |

* cited by examiner

*Primary Examiner*—David M. Purol
(74) *Attorney, Agent, or Firm*—Dilworth & Barrese LLP.

(57) ABSTRACT

A rolling door is provided with a flexible door panel which can be wound upon a winding shaft pivoted above the door opening and provided with a drive. On the bottom end of the door panel, a stop rail of length less than clear span between side sections limiting door opening, is provided at two ends with fastening for wires running over pulleys supported in a bottom region and bracing the door panel. In the side sections, slide-like blocks are guided vertically slidably, detachably connected to the ends of the stop rail by a retainer and provided with breakthroughs for the wires running from the pulleys in the bottom region to the stop rail. To restore the rolling door to operation simply and where possible even automatically after a crash, the retainer is constituted by locking devices which release the stop rail in the event of force acting thereon from the side and which, when the blocks are pressed on from above, again interlock the stop rail and blocks.

14 Claims, 3 Drawing Sheets

ROLLING DOOR WITH A FLEXIBLE DOOR LEAF

BACKGROUND OF THE INVENTION

A rolling door with a flexible door panel The invention relates to a rolling door with a flexible door panel which can be wound up on a winding shaft pivoted above the door aperture and provided with a drive, having a stop rail fixed to the bottom end of the door panel whose length is less than the clear span between the side sections limiting the door aperture and which is provided at both ends with fastenings for wires running over rollers supported in the ground area and bracing the door panel and having slide-like blocks guided vertically movably in the side sections, which blocks are detachably connected to the ends of the rails by retaining means and are provided with channels or breakthroughs for the wires running from the pulleys on the ground side to the stop rail. In a rolling door of this type known from DE 44 14 524 C2, the slide-like blocks are enclosed between top and bottom retaining pieces connected in each case to one end of the stop rail in such a way that these can only slide off the blocks in a lateral direction in the event of an impact acting on the stop section. With this known rolling door, the blocks are thus retained between fork-like retaining pieces of the stop rail by the bracing wire. To put the door back into its operational state again after a crash, it is necessary to push the fork-like retaining pieces at the two ends of the stop section laterally over the blocks again and to press the edge regions of the door panel back into the guide slots of the side door sections. While with the known rolling door it is relatively simple to put the door back into its operational state after a crash, a special adjustment is required for this purpose in every case which requires manual work.

SUMMARY OF THE INVENTION

It is therefore the object of this invention to provide a rolling door of the type first given which, after a crash which led to a detaching of the stop rail from the blocks, can more easily and where possible even automatically be returned to its operational state again.

This object is solved in accordance with the invention by the retaining means consisting of locking devices which release the stop rail in the event of forces acting thereon from the side and which, when the blocks are pressed on from above, again interlock with them.

With the rolling door in accordance with the invention, in the event of a crash the triggering of the stop rail, that is its release from the blocks, is performed in the same way as with the known rolling door. However, unlike the known rolling door, it is not necessary after a triggering of the stop rail to push its fork-like retaining pieces laterally back over the retaining parts of the blocks, which would require manual adjustment work, but rather the bracing wires pull the stop section back onto the slidelike blocks from the top so that the stop section then again interlocks with the blocks when these are travelled towards the ground by a closing movement of the door. If the operational status of the door should not be automatically reinstated by the bracing wires pulling the stop section back onto the blocks after a crash until these interlock with the block, the interlock can be effected by exerting pressure onto the stop section from above. It may also be additionally necessary after the snapping in of the interlock connection to align the stop section manually to the blocks and to press the side edges of the door panel into the side slots of the side door sections.

Appropriately, ratchet levers are pivoted on the blocks around axes running horizontally and diagonally to the plane of the door panel which ratchet levers are biased by springs towards the door panel and which are supported on these on interlock projections of the stop section below the fastenings of the wires.

To simplify the renewed interlocking of the stop section with the blocks after a deratcheting of the stop section, the interlock projections can be provided with chamfers on their bottom sides. The ratchets then slip over these chamfers until they snap into their interlocked position behind the interlock projections.

In another aspect of the invention, a sensor, for example an inductive proximity switch, is provided which generates signals when the stop section is pushed off at least one of the blocks and when the interlock connection is reinstated between the blocks and the stop section.

In accordance with a particularly preferred embodiment of the invention, it is provided that in guides of the blocks arms or slide elements are slidably guided which have a light barrier on their lower ends which, when it responds, causes a brake to engage which stops the closing movement of the door panel or which switches over the drive of the door panel to the winding up direction. The safety device consisting of the slidable arms with a light barrier which brings the stop section to a stop with great security within a stopping length which excludes any injury to persons and/or damage to objects is known per se from EP 0 284 066 B2. In this known apparatus, the arms having the light barrier are slidably guided in guides of the stop section or the lateral sword-like protrusions, which guides are parallel to the side sections. In accordance with the present invention, the slide elements or arms with the light barrier, which are generally designed in the same way as those described in EP 0 284 066 B2, are slidably guided in guides of the blocks so that current can be supplied to the light barriers simply, for example by means of trailing cables. The invention further provides the additional advantage of the wires providing the bracing of the stop section not being directly connected to the slide-like blocks guided in the vertical slots of the side stop sections of the door, but rather the blocks being provided with obliquely running breakthroughs or channels through which the wires are guided to their fastenings or fastening pieces on the stop sections. In this way, in the event of a crash pushing the stop section off the blocks, it is prevented that the slide-like blocks are pulled against the ground with great force by the wires and that the light barriers may be damaged thereby. For as the blocks are provided with the obliquely running guides for the bracing wires, after a crash detaching the stop section from the blocks, the blocks can only slide downwards under the effect of gravity until they are stoppingly supported on the bracing wires running obliquely from the pulleys on the ground side to the fastening points on the stop section. If now to interlock the stop section with the blocks again, the door is travelled downwards with the side blocks until the blocks are supported on the floor and the interlock is again restored, the blocks settle relatively gently on the ground so that no damage to the safety device consisting of the arms provided with the light barriers needs to be feared.

BRIEF DESCRIPTION OF THE INVENTION

One embodiment of the invention is described in more detail below by means of the drawing in which.

DESCRIPTION OF THE PREFERRED EMBODIMENTS

Figure 4:
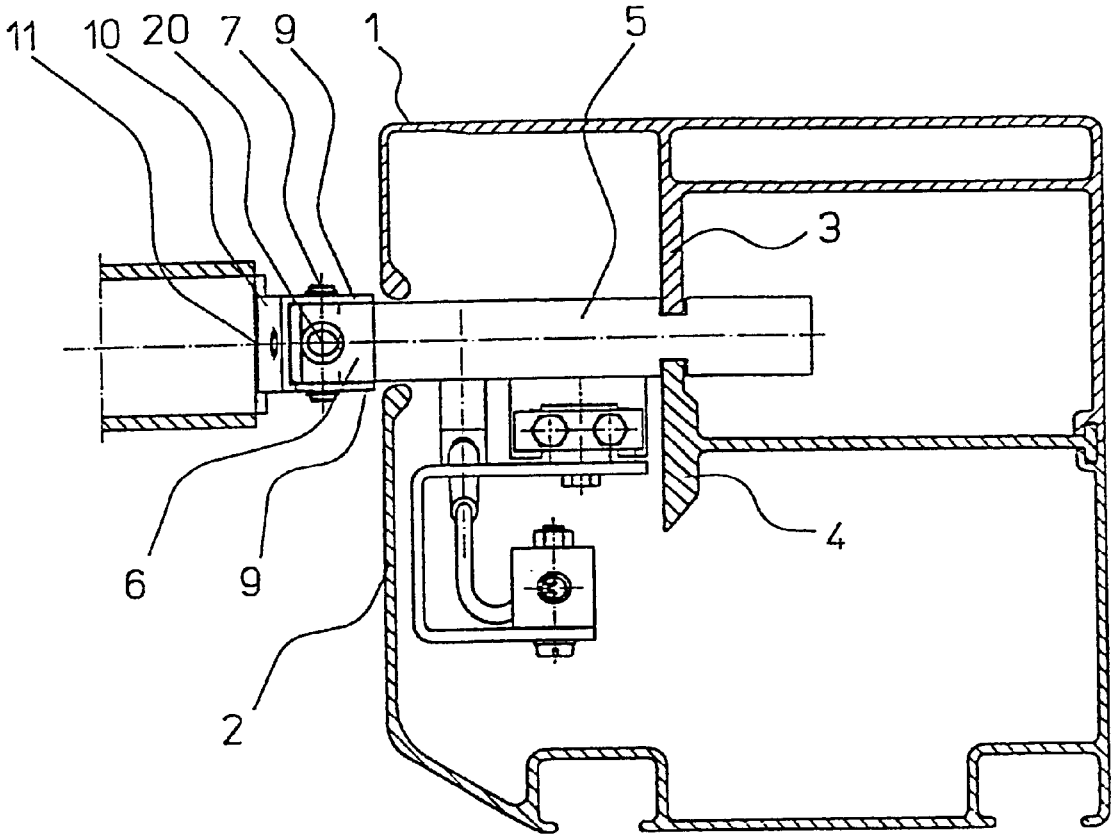
FIG. 4 shows a horizontal section through the section of FIG. 1.

A slide-like block 5 made of plastic is guided longitudinally slidably in vertical longitudinal slots of the door section which are parallel to each other and which are formed in the manner visible from FIG. 4 between the section parts 1, 2 and 3, 4. A front part 6 being essentially rectangular of the slide-like block 5 penetrates the longitudinal gap limited by the profile parts 1, 2 towards the door centre. A ratchet 8 is pivoted on this projection 6 around a lateral axis 7 which ratchet 8 consists of a sheetmetal part bent into a U shape whose legs 9 enclose the projection 6-and are provided with bearing boreholes with which these are pivoted on the axle bolt 7 held in the projection 6. The bridge part 10 of the ratchet 8, which bridge part connects the legs, possesses a front support edge 11. The projection 6 is provided with an obliquely running blind hole 12 in which a compression spring 13 is held which is supported with its one end on the bottom of the blind hole 12 and with its other end on the bridge part 10 of the ratchet.

The flexible door panel (not shown) which can be wound up on the winding shaft 15 usually carries on its bottom end the stop section 16. This stop section is provided on both sides with a retaining part 17 pointing at right angles to the side door sections which is provided with a borehole in which the bracing wire 18 is held by a knot 19 supported on the upper edge of the borehole. The bracing wire 18 penetrates the slide-like blocks 5 in guides formed by obliquely running boreholes 20. The bracing wires run from these guides to pulleys 21 supported on the ground in a fixed manner. The bracing wires are edged into line in the manner of a set of pulleys between further pulleys 22 to 25, with the pulley 25 being the pulley of a lower block biased by the tension spring 26.

The stop section 16 is provided with side fittings 28 which possess lower interlock projections 29 cantilevered parallel to the retaining parts 17. The interlock projections 29 are provided with top interlock surfaces 30 parallel to the support edges 11 of the ratchets 8. On their bottom side, the interlock projections 29 possess oblique abutting surfaces 3 1.

Figure 1:
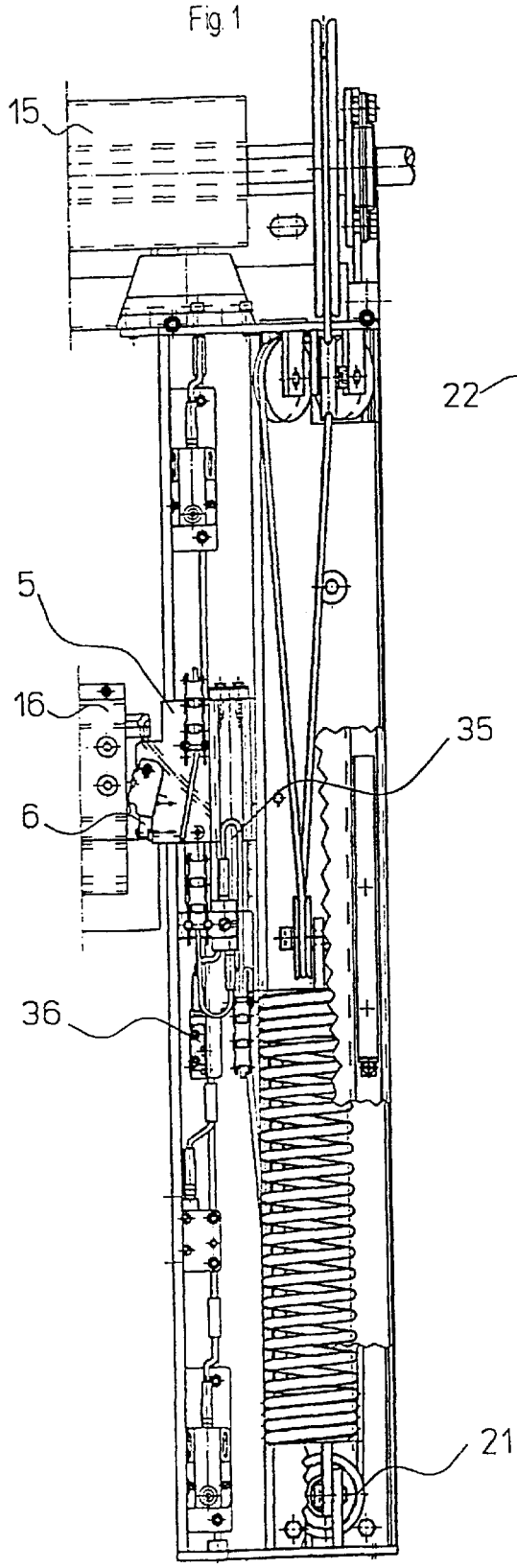
FIG. 1 shows a longitudinal section through a rolling door in the region of the right door section parallel to the plane of the door panel.
Figure 2:
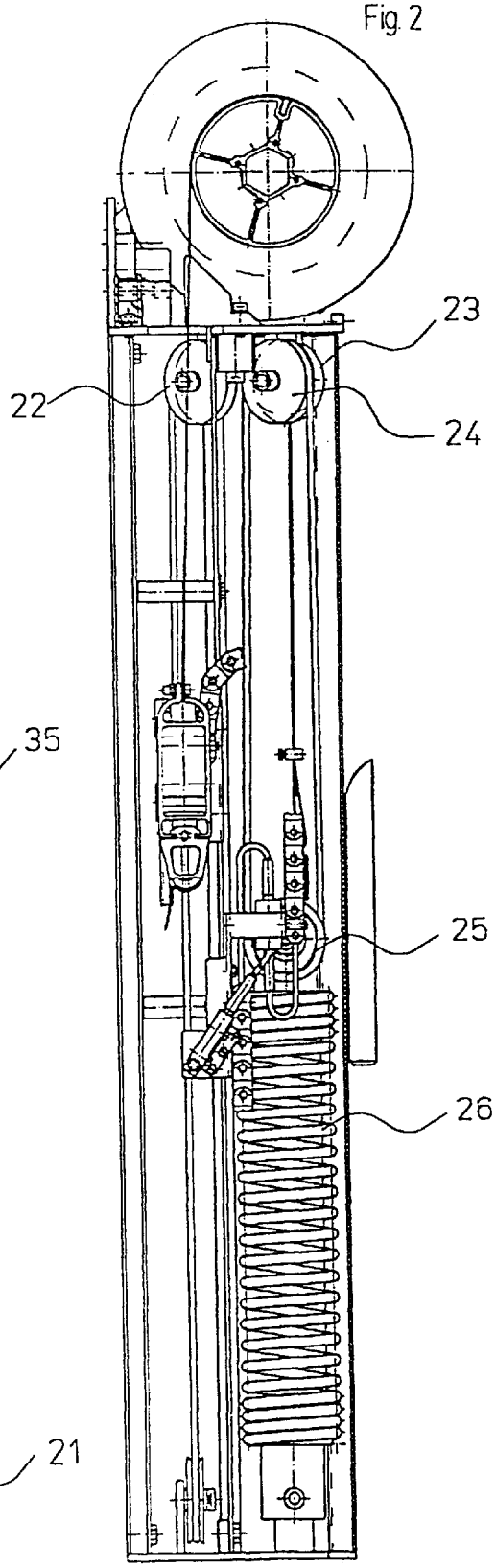
FIG. 2 shows a longitudinal section through the side section of FIG. 1.
Figure 3:
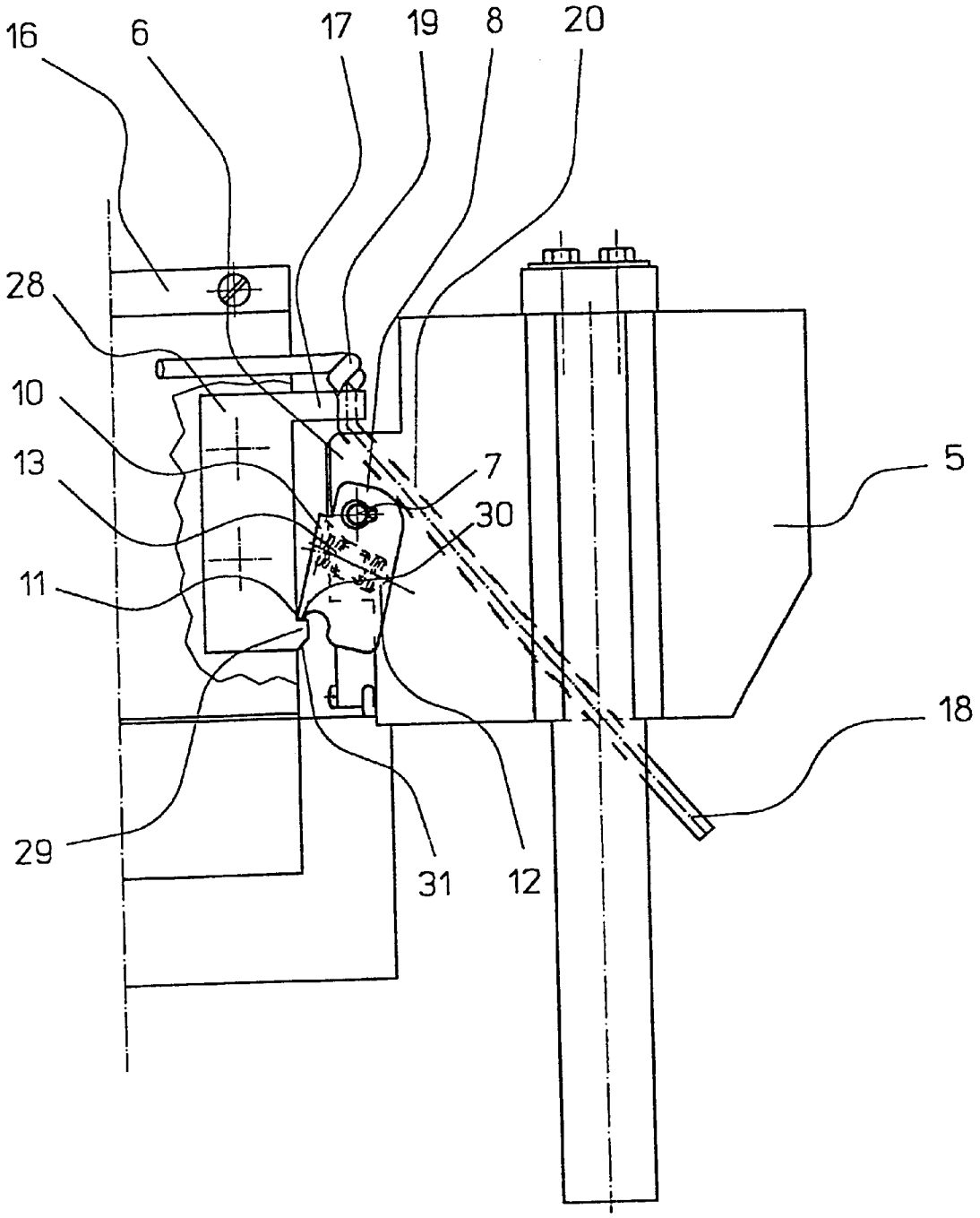
FIG. 3 shows an enlarged section of FIG. 1.

In the drawing, the door is visible in a position in which the stop section 16 is interlocked by the ratchet 8 with the slide blocks 5, that is it is located in its operating position. If, in the event of a crash, which is given, for example, when a vehicle pushes against the stop section, the stop section 16 is pushed off one of the slide blocks 5, the stop section can swing out freely with the bracing ropes 18 being pulled out. In this situation, the interlock ratchet 8 swings out into the position 10 shown by a broken line in FIG. 3. Once the cause of the crash has been removed, the bracing wires 18 again pull the stop section 16 in the direction of the slide blocks 5 so that the oblique bottom edge of the interlock projections 28 slides over the bridge parts 10 of the interlock ratchets until the lower support edge 11 of the interlock ratchet snaps into place behind the abutment surface 30.

The support edge 11 can be designed with a slight curve or concavely to allow engagement of the interlock projection 29 in a well centred manner.

The slide blocks 5 are provided with parallel boreholes on the door section in which arms 35 are guided longitudinally slidably. The arms 35 have on their lower ends light barriers 36 which cause the brake of the gear brake motor to engage which drives the winding shaft 15 in a manner not shown when the light barrier reports that a person or an object is located in the closing path of the stop section. The type of guide of the arm 35 in the slide block 5 and the effect of the light barrier 36 is known from EP 0 284 066 B2 to which reference is made for a closer description of the safety device.

If in the event of a crash, a detaching of the interlock connection is performed in a manner such that the stop section 16 of the door panel is pushed off the protrusion 6 of the slide block 5, the slide block 5 with the arm 35 which has the light barrier 36 slides so far down until the slide block 5 is held in its oblique boring hole on the obliquely running bracing wire 18. To put the door back into its operating status, the door panel is travelled into its closing position by its drive until the slide blocks 5 impact the floor and the arms 35 are pushed upwards in the guides. In this position, the bracing wires 18 pull the stop section against the slide blocks 5 so that the interlock connection is restored between the two and the door is put back into its operating status.

What is claimed is:

1. A rolling door, comprising a flexible door panel structured and arranged to be wound upon a winding shaft (15) pivoted above an aperture for the door and provided with a drive, a stop rail (16) fastened to a bottom end of the door panel and having length less than a clear span between side sections (1, 2, 3, 4) limiting door opening, pulleys (21) supported in a bottom region of the door, fastenings (17) provided at both ends of said stop rail (16), wires (18) structured and arranged to be connected to said fastenings (17), running over said pulleys (21) and bracing the door panel, slide-like blocks (5) guided vertically slidably in the side sections (1, 2, 3, 4) and detachably connected to the ends of the stop rail (16), and retaining means (8) for detachably connecting said slide-like blocks (5) to the ends of the stop rail (16) and provided with channels (20) or breakthroughs for the wires (18) running from the pulleys (21) in the bottom region to the stop rail (16), wherein said retaining means comprise interlocking devices (8, 30, 31) structured and arranged to release the stop rail (16) from said slide-like blocks, (5) in the event of force acting laterally thereon, and interlock the stop rail (16) with the slide blocks (5) again when the blocks (5) are pressed down again from above, said retaining means comprise ratchet levers (8) pivoted on the blocks (5) around axes (7) running horizontally and laterally to a plane of the door panel, springs (13) biasing said levers (8) towards the door panel, and interlock projections (29) of the stop section (16) arranged to support said ratchet levers (8) below the fastenings (17) for the wires (18).

2. A rolling door in accordance with claim 1, wherein the interlock projections (29) are provided with chamferings (31) on bottom sides thereof, such that upon interlocking, said ratchet levers (8) slip over said chamferings (31) until said ratchet levers (8) snap into interlocked position behind said projections (29).

3. A rolling door in accordance with claim 2, wherein said stop rail (16) is provided with side fittings (28) possessing said lower interlock projections (29) cantilevered parallel to said fasteners (17) and being provided with top interlock surfaces (30) parallel to support edges (11) of the ratchet levers (8).

4. A rolling door in accordance with claim 3, wherein said stop rail (16) is interlocked with said slide block (5) by said ratchet lever (8) such that, in the event of a crash, the stop rail (16) is pushed off one of the slide blocks (5) and can swing out freely with the bracing wires (18) being pulled out, and once cause of the crash has been eliminated, said bracing wires (18) again pull the stop rail (16) in the direction of the slide blocks (5) such that the chamfering or oblique bottom edge (31) of the interlock projection (29) slides over a bridge part (10) of the interlocking ratchet lever (8) until a lower support edge (11) of the interlocking ratchet lever (8) snaps into place behind the abutment surface (30).

5. A rolling door in accordance with claim 1, wherein a sensor is additionally provided which is structured and arranged to generate signals when the stop rail (16) is pushed off at least one of the blocks (5) and, when interlock connection is restored between the blocks (5) and the stop rail (16).

6. A rolling door in accordance with claim 1, additionally comprising arms (35) arranged to be guided slidably in guides of the guide blocks (5) and having, on lower ends thereof, lights barriers (36) which are structured and arranged to cause a brake to engage which either stops closing the door or switches over the drive of the door panel to winding up direction, when responding.

7. A rolling door in accordance with claim 1, structured and arranged, after detaching of the stop rail (16) from the blocks (5), to automatically return the stop rail (16) to coupling with the blocks (5).

8. A rolling door in accordance with claim 1, wherein, after disengagement of the sliding blocks (5) from the stop rail (16), said bracing wires (18) pull the stop rail (16) back into engagement with the sliding blocks (5) from above such that the stop rail (16) again interlocks with the blocks (5) when moving downwardly by closing of the door panel.

9. A rolling door in accordance with claim 1, wherein each said slide-like block (5) comprises an essentially rectangular front part (6) structured and arranged to penetrate the clearance defined by the sections (1, 2), said ratchet lever (8) being pivoted on said projection (6) around a lateral axis, and formed of a sheet-metal part bent Into a substantial U-shape and having legs (9) enclosing the projection (6) and provided with bearing boreholes, an axle bolt (7) arranged to extend through the bearing boreholes and retained in the projection (6) of the block (5) such that the ratchet (8) is pivoted on the bearing block (5), the ratchet lever (8) comprising a bridge part (10) connecting the legs (9) and having a front support edge (11), an obliquely running blind hole (12) extending through the projection (6) of the slide-like block (5), and a compression spring (13) structured and arranged to be held with one end supported at a bottom of the blind hole (12) and at another end on the bridge part (10) of the ratchet lever (8).

10. A rolling door in accordance with claim 1, wherein said stop section (16) comprises interlock projections (29) arranged to support the ratchet levers (8) below the fastenings (17) of the wires (18), the interlock projections (29) are provided with chamferings (31) on bottom sides thereof such that upon interlocking, the ratchet levers (8) slip over said chamferings (31) until the ratchet levers (8) snap into interlocked position behind the interlock projections (29), and said stop section (16) is provided with side fittings (28) possessing said lower interlock projections (29) cantilevered parallel to the fasteners (17) and provided with top interlock surfaces (30) parallel to support edges (11) of the ratchet levers (8) and possessing, on bottom sides thereof, said chamferings or oblique abutting surfaces (31).

11. A rolling door in accordance with claim 10, wherein said stop rail (16) is interlocked with said slide block (5) by said ratchet lever (8) such that, in the event of a crash, the stop rail 16) is pushed off one of the slide blocks (5) and can swing out freely with the bracing wires (18) being pulled out, and once cause of the crash has been eliminated, said bracing wires (18) again pull the stop rail (16) in the direction of the slide blocks (5) such that the chamferings or oblique bottom edge (31) of the interlock projection (29) slides over a bridge part (10) of the interlocking ratchet lever (8) until the lower support edge (11) of the interlocking ratchet lever (8) snaps into place behind the abutment surface (30).

12. A rolling door in accordance with claim 10, wherein said slide blocks (5) are provided with parallel boreholes, arms (35) are arranged to be guided longitudinally slidably in said parallel boreholes and having, on lower ends thereof, lights barriers (36) structured and arranged to cause braking of a gear brake motor to engage which drives said winding shaft (15) when the light barrier (36) senses an object or individual located in a closing path of the stop rail (16), in event of a crash, and detaching of the interlocking connection, such that the stop rail (16) is pushed off a protrusion (6) of the slide block (5), then the slide block (5) with the arm (35) supporting the light barrier (36) slides down sufficiently until the slide block (5) is retained in its oblique boring hole (20) on the obliquely running bracing wire (18), and to return to operation, the door panel moves to closing position by the drive thereof until the slide block (5) impacts a floor and the arm (35) is pushed upwardly in the guides such that the bracing wires (18) pull the stop rail (16) against the slide block (5) to restore interlocking connection between the stop section (16) and slide block (5).

13. A rolling door, comprising a flexible door panel structured and arranged to be wound upon a winding shaft (15) pivoted above an aperture for the door and provided with a drive, a stop rail (16) fastened to a bottom end of the door panel and having length less than a clear span between side sections (1, 2, 3, 4) limiting door opening, pulleys (21) supported in a bottom region of the door, fastenings (17) provided at both ends of said stop rail (16), wires (18) structured and arranged to be connected to said fastenings (17), running over said pulleys (21) and bracing the door panel, slide-like blocks (5) guided vertically slidably in the side sections (1, 2, 3, 4) and detachably connected to the ends of the stop rail (16), and retaining means (8) for detachably connecting said slide-like blocks (5) to the ends of the stop rail (16) and provided with channels (20) or breakthroughs for the wires (18) running from the pulleys (21) in the bottom region to the stop rail (16), wherein said retaining means comprise interlocking devices (8, 30, 31) structured and arranged to release the stop rail (16) from said slide-like blocks (5) in the event of force acting laterally thereon, and interlock the stop rail (16) with the slide blocks (5) again when the blocks (5) are pressed down again from above, additionally comprising said breakthroughs or channels (20) obliquely running through the blocks (5) and through which the wires (18) are guided to the fastenings (17) on the stop section (16) such that, in the event of the force pushing the stop rail (16) off the blocks (5), the blocks (5) are prevented from impacting with great force by the wires (18) and can only slide downwardly under effect of gravity until the blocks (5) are stationarily supported upon the bracing wires (18) running obliquely from the pulleys (21) in the bottom region to the fasteners (17) on the stop rail (16), and to reinterlock the stop rail (16) with the blocks (5) again, the door panel is moved downwardly with the slide blocks (5) until the blocks (5) are supported in the bottom region and again interlock with the stop rail (16).

14. A rolling door, comprising a flexible door panel structured and arranged to be wound upon a winding shaft (15) pivoted above an aperture for the door and provided with a drive, a stop rail (16) fastened to a bottom end of the door panel and having length less than a clear span between side sections (1, 2, 3, 4) limiting door opening, pulleys (21) supported in a bottom region of the door, fastenings (17) provided at both ends of said stop rail (16), wires (18) structured and arranged to be connected to said fastenings (17), running over said pulleys (21) and bracing the door panel, slide-like blocks (5) guided vertically slidably in the side sections (1, 2, 3, 4) and detachably connected to the ends of the stop rail (16), and retaining means (8) for detachably connecting said slide-like blocks (5) to the ends of the stop rail (16) and provided with channels (20) or breakthroughs for the wires (18) running from the pulleys (21) in the bottom region to the stop rail (16), wherein said retaining means comprise interlocking devices (8, 30, 31) structured and arranged to release the stop rail (16) from said slide-like blocks (5) in the event of force acting laterally thereon, and interlock the stop rail (16) with the slide blocks (5) again when the blocks (5) are pressed down again from above, said fastenings (17) each comprise a borehole for the respective bracing wire (18) to be retained therein by a knot (19) supported upon an upper edge of the borehole, said slide-like blocks (5) each comprising guides formed by said boreholes (20) obliquely running therethrough and through which a respective bracing wire (18) extends and runs from said pulleys (21) supported in the bottom region in a fixed manner, a set of additional pulleys (22–25) about which said respective bracing wire (18) passes, and a tension spring (26) arranged to bias a lowermost one (25) of said additional set of pulleys (22–25).

* * * * *